US005174443A

United States Patent [19]

Chance et al.

[11] Patent Number: 5,174,443

[45] Date of Patent: Dec. 29, 1992

[54] CIGARETTE CARTON WITH MODIFIED TUCK-IN FLAP

[75] Inventors: Christopher N. Chance, Richmond; James A. DeBlasio; Susan J. A. Douglas, both of Midlothian; Donald H. Evers, Richmond; Robert E. Talley, Chester, all of Va.

[73] Assignee: Philip Morris Incorporated, New York, N.Y.

[21] Appl. No.: 829,415

[22] Filed: Feb. 3, 1992

Related U.S. Application Data

[63] Continuation-in-part of Ser. No. 774,529, Oct. 8, 1991, Pat. No. 5,141,106.

[51] Int. Cl.[5] ..... B65D 85/10; B65D 5/54

[52] U.S. Cl. ..... 206/256; 206/273; 206/813; 229/120.011; 53/462; 53/448

[58] Field of Search ..... 53/448, 449, 462, 416, 53/466, 443; 206/813, 273, 271, 256; 229/120.011, 120.09

[56] References Cited

U.S. PATENT DOCUMENTS

| | | | |
|---|---|---|---|
| 2,109,583 | 3/1938 | Bennett | 206/813 |
| 2,565,509 | 8/1951 | Marcin | 206/813 |
| 2,605,897 | 8/1952 | Rundle | 206/264 |
| 2,697,544 | 12/1954 | Morand | 229/120.04 |
| 2,871,080 | 1/1959 | Shelly | 229/120.01 |
| 2,895,601 | 7/1959 | Krukonis | 206/256 |
| 3,071,244 | 1/1963 | Doran | 206/273 |
| 3,082,929 | 3/1963 | Aquino et al. | 206/256 |
| 3,086,650 | 4/1963 | Chapman et al. | 206/273 |
| 3,113,673 | 12/1963 | Stein | 206/65 |
| 3,135,457 | 6/1964 | Risucci | 229/120.011 |
| 3,144,190 | 8/1964 | Holt et al. | 229/27 |
| 3,163,351 | 12/1964 | Borgardt | 206/256 |
| 3,447,733 | 6/1969 | Smith et al. | 206/491 |
| 3,503,568 | 3/1970 | Galley | 242/74 |
| 3,536,246 | 10/1970 | Rosen | 206/256 |
| 3,596,758 | 8/1971 | Phillips, Jr. et al. | 206/256 |
| 3,721,335 | 3/1973 | Grant | 206/256 |
| 3,752,308 | 8/1973 | Begemann | 206/273 |
| 3,759,378 | 9/1973 | Werth | 206/429 |
| 3,809,227 | 5/1974 | Begemann | 206/264 |
| 4,424,658 | 1/1984 | Focke | 53/398 |
| 4,441,611 | 4/1984 | Sommariva | 206/431 |
| 4,485,926 | 12/1984 | Lenzemeier | 206/602 |
| 4,631,900 | 12/1986 | Mattei et al. | 53/448 |
| 4,669,611 | 6/1987 | Flaherty | 206/449 |
| 4,738,359 | 4/1988 | Phillips, Jr. | 206/256 |
| 4,928,817 | 5/1990 | Focke | 206/264 |
| 4,932,534 | 6/1990 | Focke et al. | 206/602 |
| 5,058,363 | 10/1991 | Focke et al. | 53/462 |

FOREIGN PATENT DOCUMENTS 358560 10/1931 United Kingdom .

*Primary Examiner*—William I. Price

*Attorney, Agent, or Firm*—Jeffrey H. Ingerman; Karen G. Horowitz

[57] ABSTRACT

A carton having a tuck-in flap extending from each wall which travels substantially parallel to the path of travel through a tax-stamping machine. At least one tuck-in flap is provided with a tapered tuck-in portion which is positioned and dimensioned so that the hold-down guide positioned to hold down the shorter of a pair of lap flaps of a conventional cigarette carton will hold down the tuck-in flap having the taper as if it were a short lap flap. Moreover, the longer portion of the tapered tuck-in flap is properly held down as well, without being snagged by the hold-down guide. An additional extension panel may be provided along the free edge of the tuck-in portion of either or both tuck-in flaps. The tuck-in portion may be folded under the top closure portion of the tuck-in flap, and the additional extension panel tucked between the cigarette packs in the carton and the wall from which the folded tuck-in flap extends. The folded tuck-in flap thus resembles a short lap flap which may be sufficiently held down by the hold-down guide for a short lap flap.

59 Claims, 10 Drawing Sheets

FIG. 1
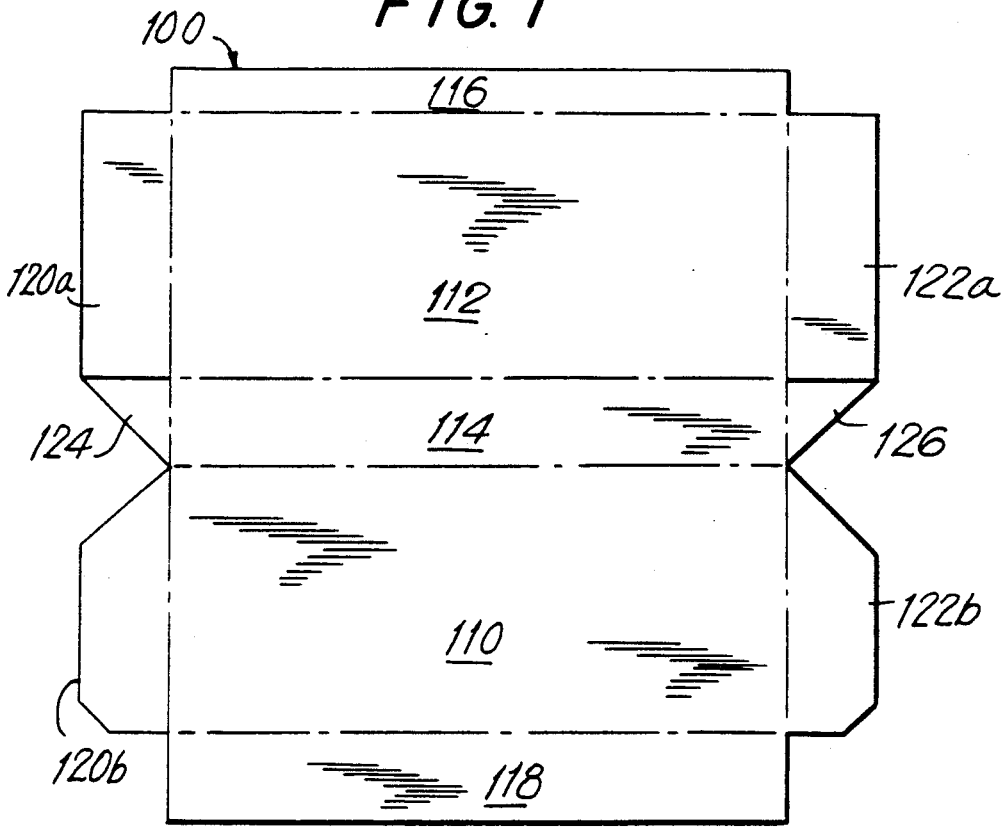
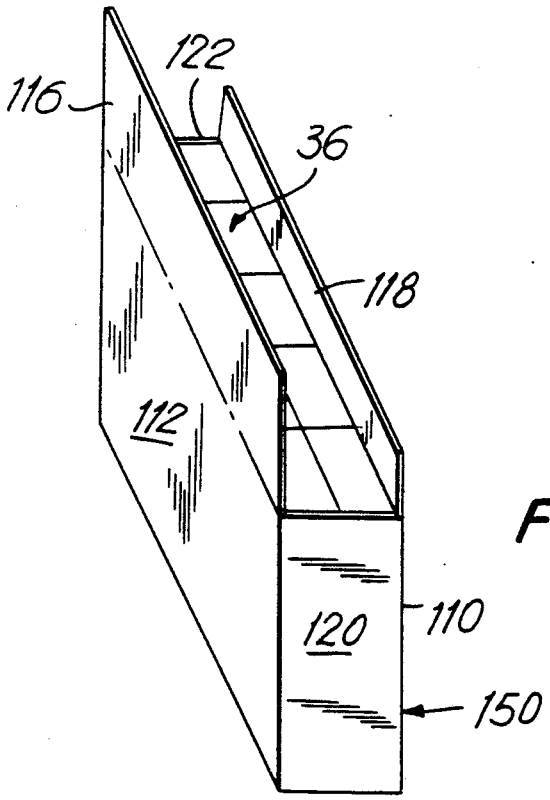
FIG. 2

CIGARETTE CARTON WITH MODIFIED TUCK-IN FLAP

CROSS REFERENCE TO RELATED APPLICATION

This application is a continuation-in-part of copending, commonly-assigned United States patent application Ser. No. 07/774,529, filed Oct. 8, 1991, now U.S. Pat. No. 5,141,106 which is hereby incorporated by reference in its entirety.

BACKGROUND OF THE INVENTION

This invention relates to cigarette cartons having tuck-in flaps and which are compatible with commercially available cigarette carton processing equipment, so that modifications to such equipment are not required. More particularly, this invention relates to the design of tuck-in flaps on cigarette cartons such that the cartons may be passed through commercially available tax-stamping equipment without modifying the tax-stamping equipment.

Cigarette packs (which usually contain twenty cigarettes) are generally rectangular in shape, having front and back long walls connected by two short side walls. Cigarette cartons typically contain two rows of five cigarette packs per row (each row arranged so that the front long walls of the packs are in the same plane and the back long walls are in a parallel plane spaced from the front long walls, and the side walls abut one another), and are generally known in the art as ten-pack cartons. Typically, such cartons have lap flaps, i.e., an extension panel from each long wall of the carton (the wall parallel to the long walls of the packs contained in the carton). One flap is usually longer than the other. The longer flap extends the entire distance between the long walls, and the shorter flap need be of sufficient length for the long flap to be adequately secured to it to close the carton. After the cartons are filled with cigarette packs by the manufacturer, the lap flaps are overlapped (with the shorter flap positioned below the long lap flap, adjacent the packs) and releasably secured to one another to temporarily close the carton. The cartons then are shipped to various distributors. The distributors generally open the cartons to apply the tax stamp that may be required by the jurisdiction in which they operate to the ends of individual cigarette packs while the packs are still inside the cartons. Such procedures are commonly automated, to reduce time, cost, and labor, through the use of specially designed machines for applying tax stamps. Tax-stamping machines have been developed to open the cartons, apply the stamps, and finally seal the cartons for distribution. Such machines are generally commercially available, and are well known in the art. These machines have been developed for ten-pack cartons, i.e., cartons containing two rows of five cigarette packs per row, which have lap flaps such as described above. A typical tax-stamping machine is model FUSON manufactured by Meyercord of 365 East North Avenue, Carol Stream, Ill. 60187.

To assist in opening the cigarette cartons when in the tax-stamping machine, a set of pinch roller squeeze the long walls of the cartons so that the top flaps bow upward. A curved plow then is inserted between the flaps and the packs in the carton to separate the flaps. Hold-down guides are provided downstream of the leading edge of the plow to hold the flaps down adjacent the long walls of the cartons so that the packs inside the cartons are fully exposed and a tax-stamper may apply the required tax stamp to the ends of the packs. Because one lap flap is commonly shorter than the other lap flap, one hold-down guide is positioned higher than the other to accommodate the shorter flap. If a flap which is longer than the short flap is provided on the side of the carton engaging the higher positioned hold-down guide, the longer portion of the flap tends to be snagged by the hold-down guide and consequently deformed or even torn. Such snagging typically causes the machine to jam, causing back-up in production and additional labor costs for repairs. Deformation or tearing also would negatively affect marketability of the carton, if the carton is at all salvageable.

Such snagging may be prevented by modifying the hold-down guide, but such modification slows down the tax-stamping process and requires additional, time-consuming and consequently expensive steps. Therefore, it is usually economically prohibitive to provide cartons having flaps longer than the common length of the short flap.

Nonetheless, when joining single row cartons such as described in above-mentioned United States patent application Ser. No. 07/774,529, flaps longer than the common length of the short flap may be desirable over flaps of standard dimensions, such as lap flaps, for reasons as follows. Although such dual cartons may be provided with two pairs of lap flaps, which would not cause snagging problems, the flaps extending from the walls along which the cartons are joined must be positioned out of the way of the tax-stamper. Accordingly, such flaps may be positioned between the abutting long walls of the cartons, but must later be pulled from this position to seal the carton for distribution to consumers. Such an additional step would be time-consuming and expensive. Thus, tuck-in flaps would be preferable because when positioned along the exterior walls (the non-abutting walls) of the dual carton, they may be lapped over one another and opened by the tax-stamping machine without later additional steps. Furthermore, such flaps allow the consumer to reclose the carton. However, the tuck-in portion of the flaps causes both flaps to be longer than the length of the short lap flap of the typical ten-pack carton, thus causing the tuck-in portion adjacent the higher-positioned hold-down guide to be snagged.

SUMMARY OF THE INVENTION

It is therefore an object of this invention to provide a carton having a tuck-in flap extending from each long wall of the carton which encounters a hold-down guide which flap is dimensioned so that it is not snagged by the hold-down guide it engages.

It is a further object of this invention to provide tuck-in flaps accomplishing the first-mentioned object, which are of sufficient length to be retained in a closed, tucked-in position.

It is another object of this invention to provide a carton having tuck-in flaps accomplishing the first-mentioned object, and which may be passed through a tax-stamping machine irrespective of which end of the carton encounters the hold-down guides first.

It is yet another object of this invention to provide a tuck-in flap which may easily be tucked into a carton by automated equipment.

These and other objects of the invention are accomplished in accordance with the principles of the invention by providing a tuck-in flap along each wall of a cigarette carton which encounters a hold-down guide, at least one of each flap having a tapered tuck-in portion. The shortest part of the tuck-in portion is short enough to avoid being snagged by a hold-down guide, but is of sufficient length to retain the tuck-in flap in the tucked position. Preferably at least one short part of the tapered tuck-in portion of the tuck-in flap is adjacent each end of the carton transverse to the path of travel. Thus, either end of the carton may encounter the hold-down guides without presenting a flap which would be snagged by the higher positioned hold-down guide (which holds down the short lap flap).

BRIEF DESCRIPTION OF THE DRAWINGS

Further features of the invention, its nature, and various advantages will be more apparent from the following detailed description of the preferred embodiments and the accompanying drawings wherein like reference characters represent like elements throughout, and in which:

FIG. 1 is a plan view of an illustrative carton blank for a cigarette carton which is typically passed through automated cigarette carton processing equipment;

FIG. 2 is an isometric view of a carton formed from the blank of FIG. 1;

DETAILED DESCRIPTION OF THE INVENTION

Figure 3:
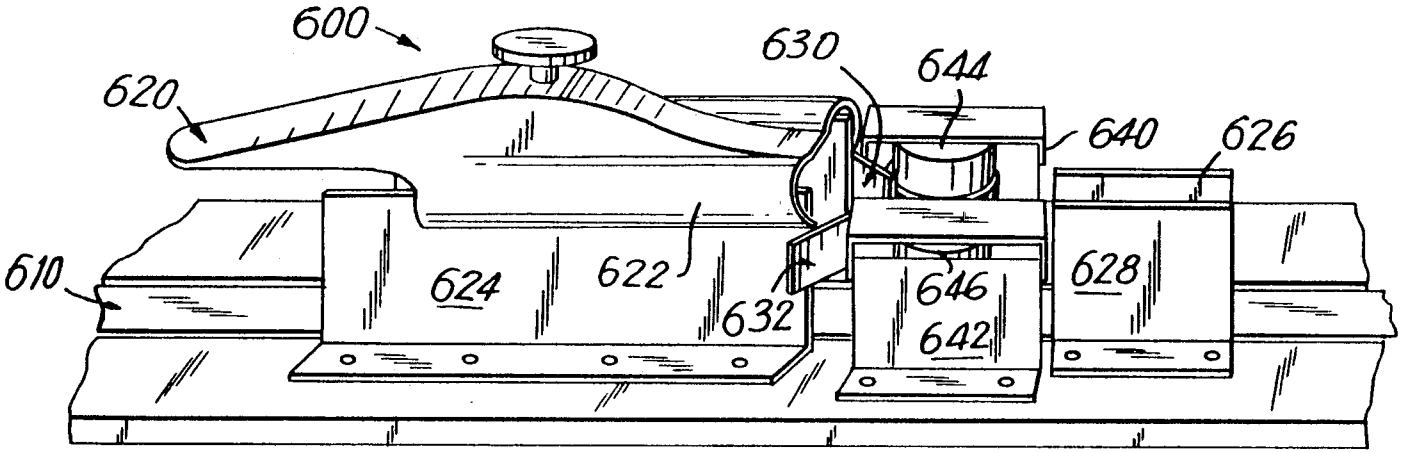
FIG. 3 is an isometric view of the carton-opening portion of a tax-stamping machine.

Blank 100, shown in FIG. 1, is typical of blanks used for cigarette cartons. Blank 100 is preferably formed from a substantially rigid material such as paperboard or cardboard, and has a plurality of fold lines represented as broken lines (not individually labeled) along which the panels are folded to form the carton. Panels 110 and 112 form, respectively, the front and rear walls of the carton, and each are preferably approximately five times the width of a long wall of a cigarette pack to be enclosed in the completed carton. These panels each extend from, and are subsequently joined along bottom panel 114, which is preferably the same width as the front and rear panels. Preferably, the length of bottom panel 114 is at least as long as either one or two times the width of the short wall of a cigarette pack to be enclosed in the completed carton. Hence, the carton formed from blank 100 is dimensioned to contain either five cigarette packs or ten cigarette packs arranged in rows of five packs per row, the packs arranged with their short walls abutting one another. As used herein, a cigarette pack is defined as any pack commonly used for holding a predetermined number of cigarettes, and generally having front and back long walls connected by two short side walls. Extension panels 116 and 118, extending from panels 112 and 110, respectively, form a pair of lap flaps for closing the formed carton. Panel 116 is preferably the same dimension as bottom panel 114 and is to be folded over panel 118, which may be any desired dimension which provides sufficient surface area for joining panels 116 and 118. Dust flaps 124 and 126 are folded preferably perpendicular to bottom wall 114. Side panels **120*b* and 122*b* are then folded adjacent dust flaps 124 and 126, respectively, and substantially perpendicular to panel 110. Side panels 120*a* and 122*a* are folded over side panels 120*b* and 122*b*, respectively, to complete side wall 120, formed by side panels 120*a* and 120*b*, and side wall 122, formed by side panels 122*a* and 122*b***.

Completed carton 150, formed from blank 100, is shown in FIG. 2, filled with cigarette packs 36. Flaps 116 and 118 are shown open, exposing packs 36 so that a tax stamp may be applied to the ends of the packs. Because flap 118 is shorter than flap 116, and preferably approximately one half the length of flap 116, the orientation of the carton is important when it is passed through a tax-stamping machine. Thus, if the hold-down guide for the shorter flap is on the right side of the conveyor path, side wall 122 must be the leading side of the carton into the machine.

The carton opening portion 600 of a typical tax-stamping machine is shown in FIG. 3. A cigarette carton such as carton 150, having lap flap 116 folded over and temporarily secured to lap flap 118 with releasable adhesive, is opened for tax-stamping as follows. Cigarette carton 150 travels along path 610 lengthwise, i.e., with long walls 110 and 112 of carton 150 substantially parallel to path 610. Walls 110 and 112 of carton 150 are squeezed together by pinch rollers (not shown) similar to pinch rollers 644 and 646 to cause lapped flaps 116 and 118, temporarily secured together, to bow upwards. Plow 620 can then be inserted between the flaps and the cigarette packs in carton 150 to plow open the lapped flaps. The bottom portion of the plow widens to bend the flap substantially perpendicular to walls 110 and 112 of the carton, and the carton is then passed under contoured portion 622 which further bends the flaps toward walls 110 and 112. After leaving contoured portion 622, lap flaps 116 and 118 may not be completely flat against walls 110 and 112, as would be desirable. Hold-down guides, described in greater detail below, further fold lap flaps 116 and 118 so that they lie substantially parallel to and flat against walls 110 and 112. Lap flaps 116 and 118 are substantially flat against walls 110 and 112 when carton 150 passes between pinch rollers 644 and 646, housed in housings 640 and 642, which further flatten the lap flaps against the walls. Thus, lap flaps 116 and 118 will not obstruct the cigarette packs in carton 150 when carton 150 is passed through the tax-stamping portion of the tax-stamping machine. To maintain lap flaps 116 and 118 in this position, carton 150 is guided between walls such as walls 626 and 628.

Figure 4:
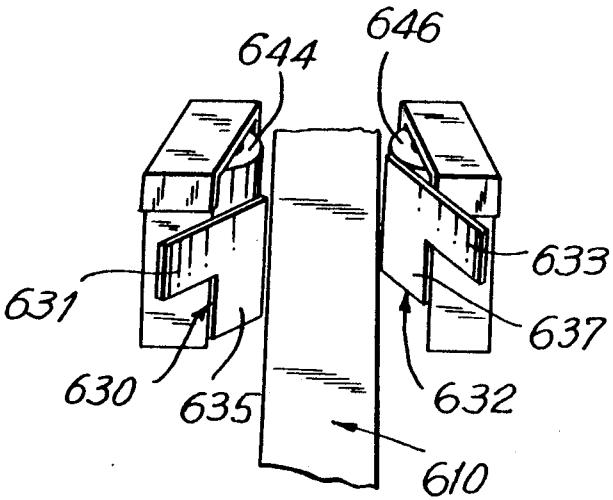
FIG. 4 is an isolated end view of hold-down guides of a tax-stamping machine.

An end view of hold-down guides 630 and 632 is shown in FIG. 4, as seen from path 610, approaching the hold-down guides. Each hold-down guide 630 and 632 is substantially L-shaped, having an upper horizontal portion 631, 633, and a lower vertical portion 635, 637. Hold-down guides 630 and 632 are positioned at an angle to path 610, so that the space between hold-down guides 630 and 632 narrows as carton 150 passes through the guides. The ends of lap flaps 116 and 118 encounter and are pushed down by horizontal portions 631 and 633 to be substantially flat against walls 110 and 112.

Figure 5:
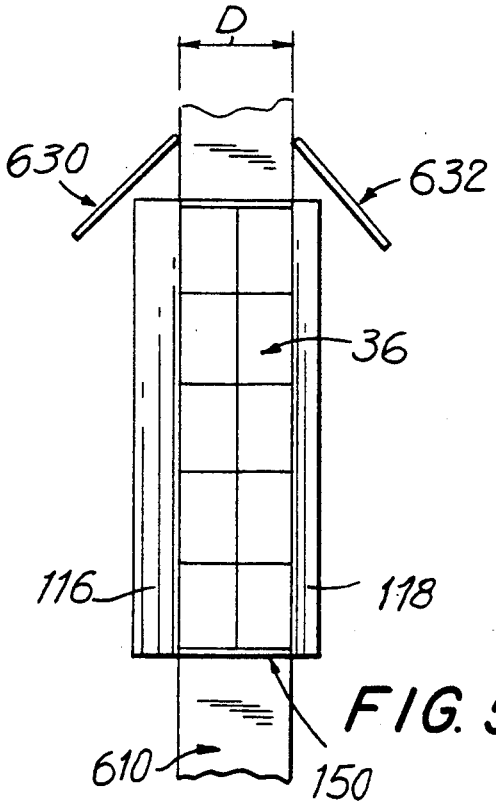
FIG. 5 is a top view of an open cigarette carton approaching hold-down guides.

An overhead view of carton 150 approaching hold-down guides 630 and 632 is shown in FIG. 5. Lap flaps 116 and 118 ar®shown, in exaggeration, as not completely flat against walls 110 and 112. Thus, although the width of carton 150 is substantially the same as distance D between hold-down guides 630 and 632, lap flaps 116 and 118 extend the apparent width of carton 150 beyond distance D. The protruding ends of lap flaps 116 and 118 encounter hold-down guides 630 and 632 and are progressively pushed closer to walls 110 and 112 as hold-down guides 630 and 632 become closer to each other downstream of path 610.

Figure 6:
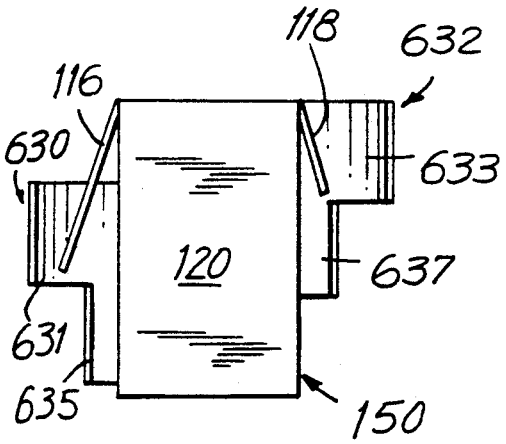
FIG. 6 is an end view of an open typical cigarette carton approaching hold-down guides.

The paperboard from which carton 150 is formed has "memory", such that when lap flaps 116 and 118 are folded, they tend to fold back to a position substantially parallel to walls 110 and 112, i.e., the position in which they are when the carton is still an unfolded blank. As shown in FIG. 6, because lap flap 116 is longer than lap flap 118, horizontal portion 631 is positioned lower than horizontal portion 633. The bottom edge of lap flap 116 barely extends below the bottom edge of horizontal portion 631, and the bottom edge of lap flap 118 barely extends below the bottom edge of horizontal portion 633. Thus, any portion of either lap flap 116 or 118 which resists being folded will be held down by horizontal portions 631 and 633, respectively.

When five-pack cartons formed from a blank similar to blank 100 are used to form a dual carton such as the dual carton described in above-mentioned U.S. Patent application Ser. No. 07/774,529, front walls 110 are positioned adjacent and coextensive with one another and flaps 118 must be folded down between walls 110, so that they are not in the way of the tax-stamper. Preferably, five-pack cartons having tuck-in flaps which may be overlapped to temporarily close the cartons are used instead. Tuck-in flaps of five-pack cartons typically have a top closure panel which is approximately the same size as short lap flap 118 of a ten-pack carton, and an additional tuck-in portion, which is tucked into the carton to close the carton. Such cartons also allow for opening and reclosing of the carton by the consumer.

Figure 7:
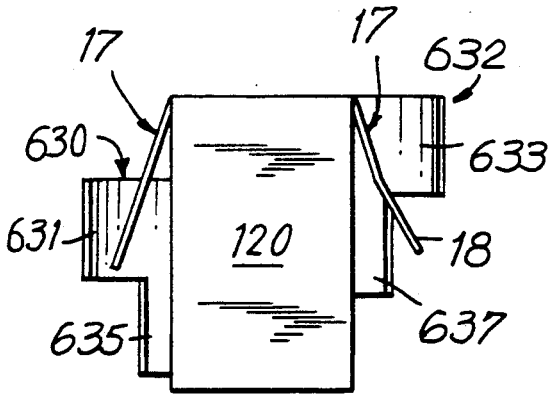
FIG. 7 is an end view of an open cigarette carton having a tuck-in flap on each side approaching hold-down guides.
Figure 8:
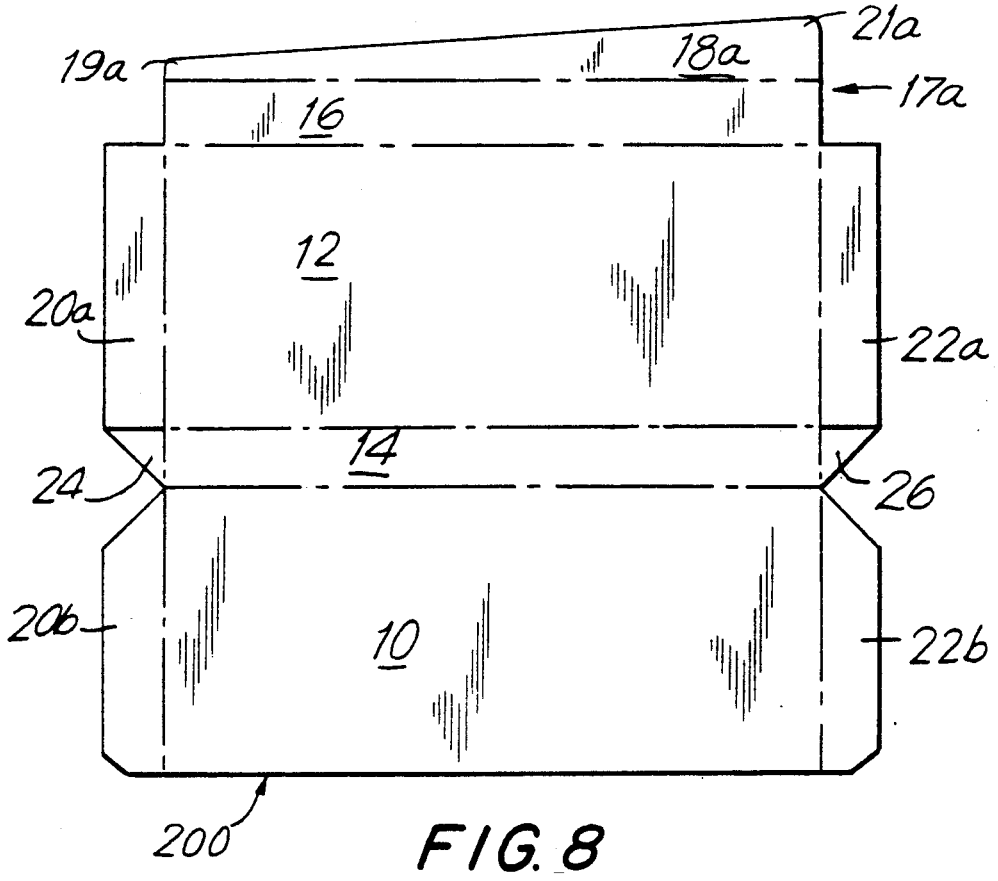
FIG. 8 is a plan view of an illustrative carton blank for a five-pack carton in accordance with this invention.

When five-pack cartons with tuck-in flaps are secured together to form a dual carton, the tuck-in flaps are preferably positioned so that they are along the exterior of the dual carton in substantially the same positions as lap flaps 116 and 118, and may be overlapped to close the carton. The tuck-in portion of the tuck-in flaps of each of the joined cartons is preferably the same dimension as the top closure panel so that each tuck-in flap will extend across the entire top of the ten-pack carton. Such tuck-in flaps may be plowed open by plow 620 as lap flaps 116 and 118 are plowed open. However, as shown in FIG. 7, tuck-in flap 17 consequently is longer than short lap flap 118 of a typical ten-pack carton, and tuck-in portion 18 extends below horizontal portion 633 of hold-down guide 632. The "memory" of tuck-in portion 18 typically prevents tuck-in portion 18 from being held down with the remainder of tuck-in flap 17, and tuck-in portion 18 is thus easily snagged by vertical portion 637 of hold-down guide 632. Blanks 200, 300, 400, and 500 of FIGS. 8, 9, 10, and 11, respectively, provide tuck-in flaps having tapered tuck-in portions so that the shortest part of the tapered tuck-in portion is properly held down by hold-down guide 632 and does not have sufficient "memory" to extend beyond the plane of tuck-in flap 17 and be snagged. Once the longer portion of the tapered tuck-in portion reaches the hold-down guide, the entire flap is already adequately held down so that the longer portion also remains substantially flat against the walls of the carton and is not snagged.

Each of blanks 200, 300, 400, and 500 of FIGS. 8, 9, 10 and 11 have a front panel 10, and a rear panel 12 which are substantially the same as panels 110 and 112 of blank 100. Bottom panel 14 is preferably the same width as panels 10 and 12, and sufficiently longer than the width of the short wall of a cigarette pack, so that the carton formed from blank 200 is dimensioned to contain one row of five cigarette packs. Dust flaps 24 and 26, which correspond to dust flaps 124 and 126 of blank 100, are folded preferably perpendicular to bottom wall 14. Side panels **20*b* and 22*b* are then folded adjacent dust flaps 24 and 26, respectively, and substantially perpendicular to panel 10. Side panels 20*a* and 22*a* are folded over side panels 20*b* and 22*b*, respectively, to complete side wall 20, formed by side panels 20*a* and 20*b*, and side wall 22, formed by side panels 22*a* and 22*b*. The width of each of side walls 20 and 22 is the same as the length of bottom wall 14. Each half of blank 500 is substantially identical to blank 200. The halves of blank 500 which each form a separate five-pack carton are joined along a line of weakness such as perforated line 31**.

Instead of having lap flaps, the cartons formed from blanks 200, 300, 400, and 500 have a tuck-in flap composed of a top closure panel 16 and a tuck-in panel 18, having an end 19 adjacent wall 20, and an end 21 adjacent wall 22. Top closure panel 16 is substantially rectangular and the same dimension for each of blanks 200, 300, 400, and 500. Tuck-in panel 18 of each of blanks 200, 300, 400, and 500 is tapered.

Tuck-in panel 18*a* of blanks 200 and 500 has a single taper along the entire width of panel 18*a*. The length of end 19*a* is preferably short enough so that the hold-down guide which usually holds down the shorter lap flap of a cigarette carton does not snag the remaining longer section of tuck-in flap 17*a*, formed by top closure panel 16 and tuck-in panel 18*a*, when side wall 20 is the first side wall to approach the tax-stamping machine and end 19*a* is on the side of a hold-down guide for a short lap flap. Furthermore, the length of end 19*a* also is preferably long enough so that it will remain tucked inside the carton to close the carton, when desired. A length which satisfies both such requirements is approximately one-quarter the length of top closure panel 16. The length of end 21*a* is preferably the same as the length of top closure panel 16.

Cartons 30 and 32, which form the dual cartons of FIGS. 12–17, are joined so that the tuck-in flaps 17 extend from walls which remain visible after the cartons are joined, i.e., walls 12, hereinafter referred to as exterior walls 13. Because "a" panels 20*a* and 22*a* are preferably folded over "b" panels 20*b* and 22*b*, the free edges of each of the "a" panels of the side walls faces inwardly, i.e., the free edges lie adjacent walls 10, hereinafter referred to as interior walls 11, when cartons 30, 32 are joined. In this configuration, the free edges of the "a" panels are not readily accessible and thus are relatively safe from being accidentally lifted from their place adjacent the "b" panels.

Figure 12:
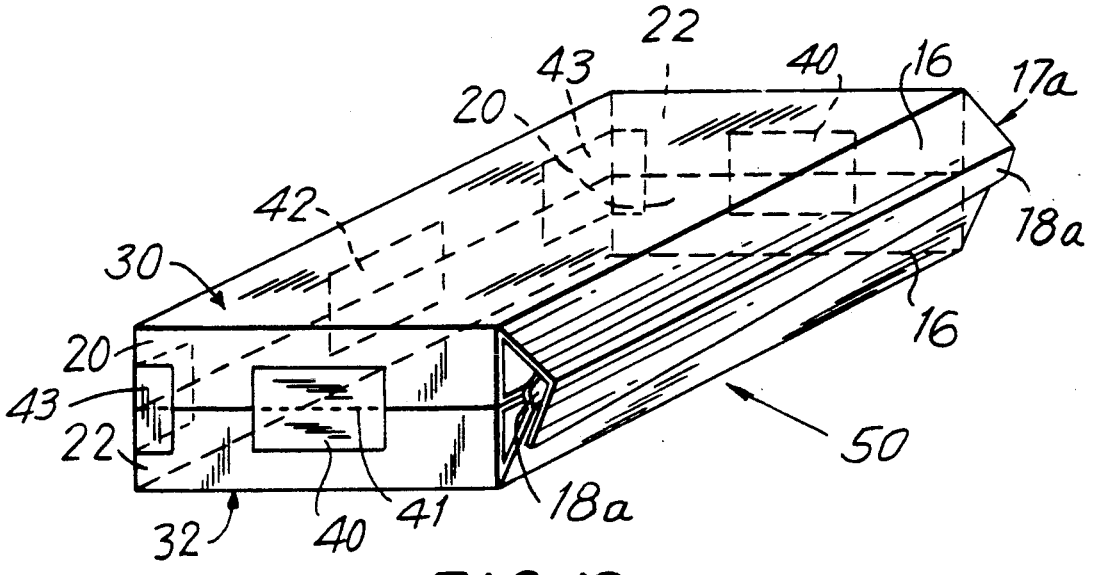
FIG. 12 is an isometric view of two five-pack cartons formed from the blank of FIG. 8, joined to form a dual carton, and having their tuck-in flaps overlapped.
Figure 9:
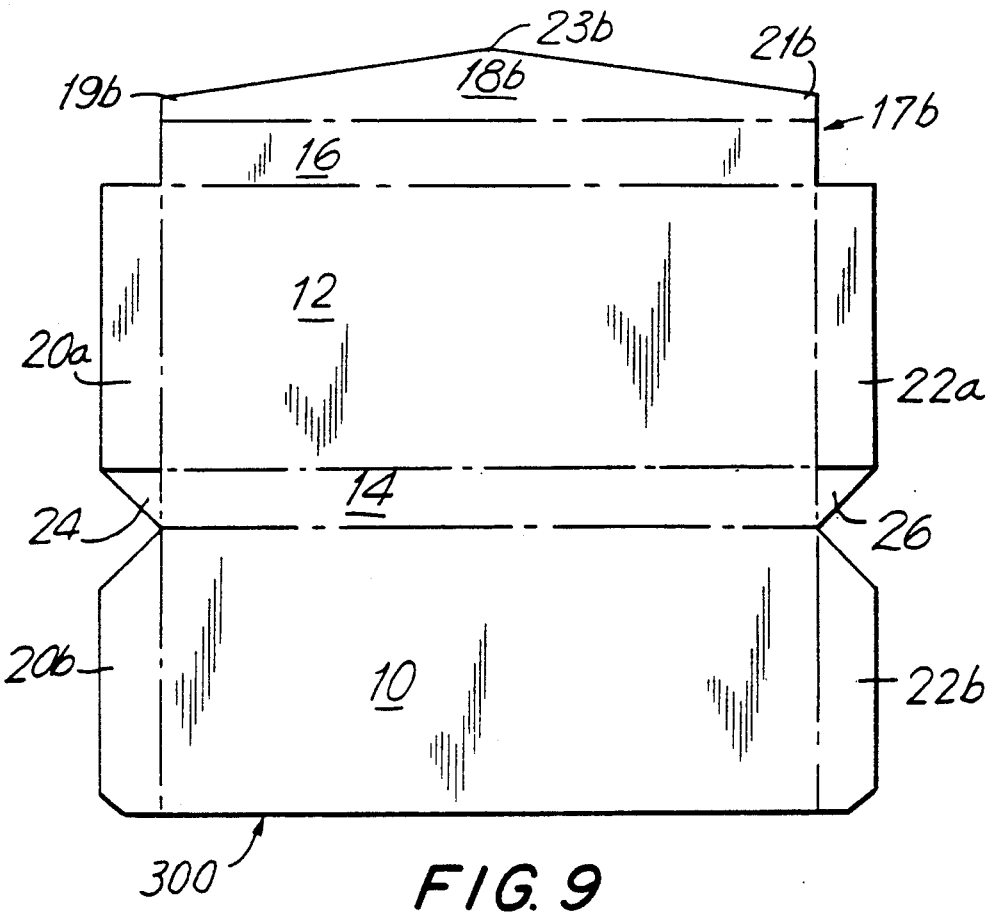
FIG. 9 is a plan view of an illustrative carton blank similar to that of FIG. 8, but having a modified tuck-in portion.
Figure 15:
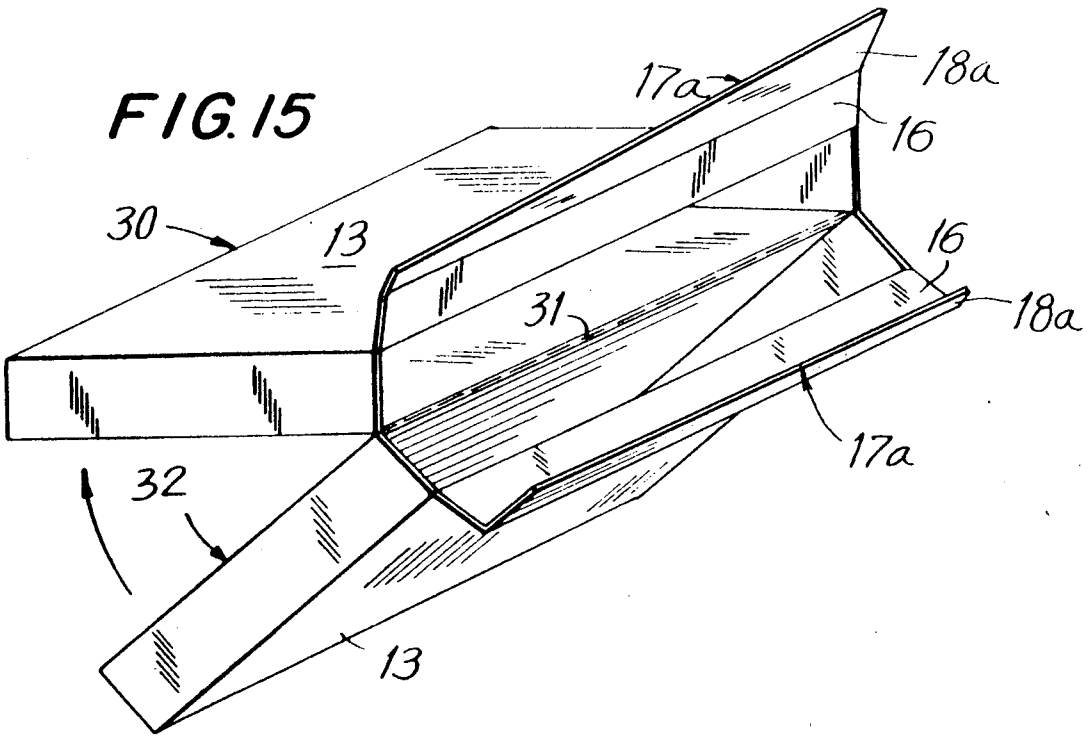
FIG. 15 is an isometric view of the final step in forming a ten-pack carton from two five-pack cartons constructed from the blank of FIG. 11.

As shown in FIG. 12, when two blanks 200 are folded into cartons 30 and 32 and joined to form dual carton 50, tuck-in flaps 17*a* may be overlapped to temporarily seal the dual carton. Because end 21*a* of tuck-in panel 18*a* is substantially the same length as top closure panel 16, the longest end 21*a* of tuck-in flaps 17*a* of cartons 30 and 32 will extend across the entire top of dual carton 50. Tuck-in flaps 17*a* of the dual carton formed by blank 500, may similarly be overlapped. The final stages of folding blank 500 into a dual carton are shown in FIG. 15. The cartons may be joined by carrier means bearing adhesive such as labels 40, applied across adjacent coplanar side walls, label 42, applied across the bottom walls, and label 43, applied across the corners of cartons 30 and 32, or other labels such as those shown in above-mentioned U.S. Patent application Ser. No. 07/774,529. Tuck-in flaps 17*a* may be joined by releasable adhesive or by a label similar to the above-mentioned labels. Any of the above-mentioned labels may optionally bear pricing indicia such as Universal Product Code (U.P.C.) indicia for the automatic pricing of the dual carton, such as described in co-pending, commonly assigned U.S. Patent application Ser. No. 07/792,617, which is hereby incorporated by reference in its entirety. The indicia are preferably positioned such that they are rendered unreadable by automatic scanning equipment upon separating the cartons. Preferably, if pricing indicia are included, only one label bearing pricing indicia is used.

Tuck-in panel 18*b* of blank 300 has two tapers along the width of panel 18*b*. The tapers join at pointed central section 23*b* preferably proximal the center of panel 18*b*. The length of ends 19*b* and 21*b* of panel 18*b* which are adjacent the side walls of the carton formed from blank 300 is preferably short enough so that the hold-down guide which usually holds down the shorter lap flap of a cigarette carton does not snag tuck-in panel 18*b*. Furthermore, the length of ends 19*b* and 21*b* of panel 18*b* also is preferably long enough so that tuck-in flap 17*b* will remain tucked inside the carton, when desired. A length which satisfies both such requirements is approximately one-quarter the length of top closure panel 16. The length of the pointed central portion 23*b* of tuck-in panel 18*b* is preferably the same as the length of top closure panel 16.

Figure 13:
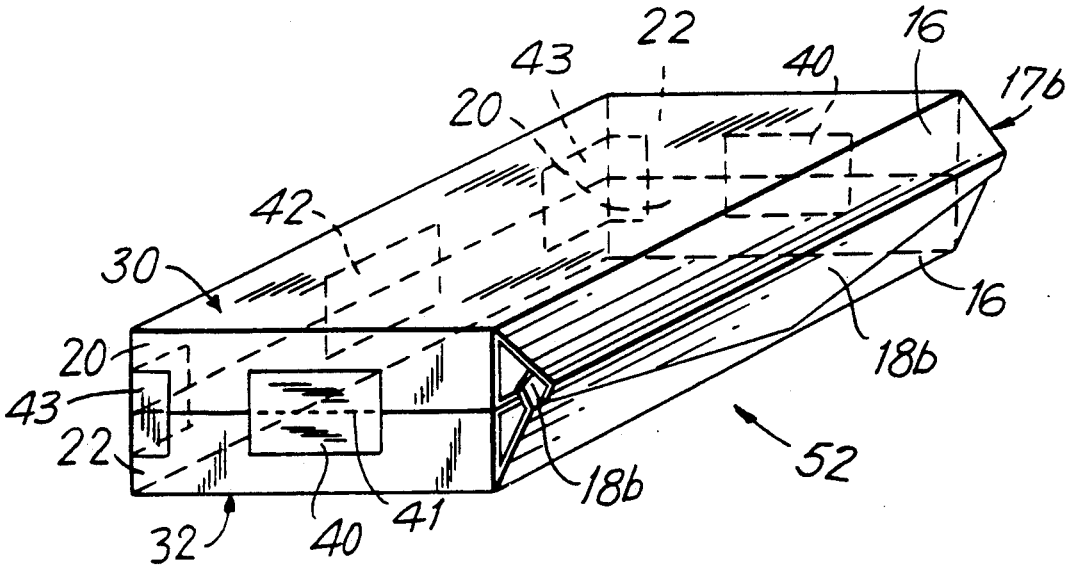
FIG. 13 is an isometric view of two five-pack cartons formed from the blank of FIG. 9, joined to form a dual carton, and having their tuck-in flaps overlapped.

As shown in FIG. 13, when two blanks 300 are folded into cartons 30 and 32 and joined to form dual carton 52, tuck-in flaps 17*b* may be overlapped to temporarily seal the dual carton. Because central portion 23*b* of tuck-in portion 18*b* is substantially the same length as top closure panel 16, central portion 23*b* of tuck-in flaps 17*b* of cartons 30 and 32 will extend across the entire top of dual carton 52. The cartons may be joined by labels 40, 42, and 43, such as those shown in FIG. 12. Tuck-in flaps 17*a* may be joined by releasable adhesive or by a label similar to the above-mentioned labels.

Figure 10:
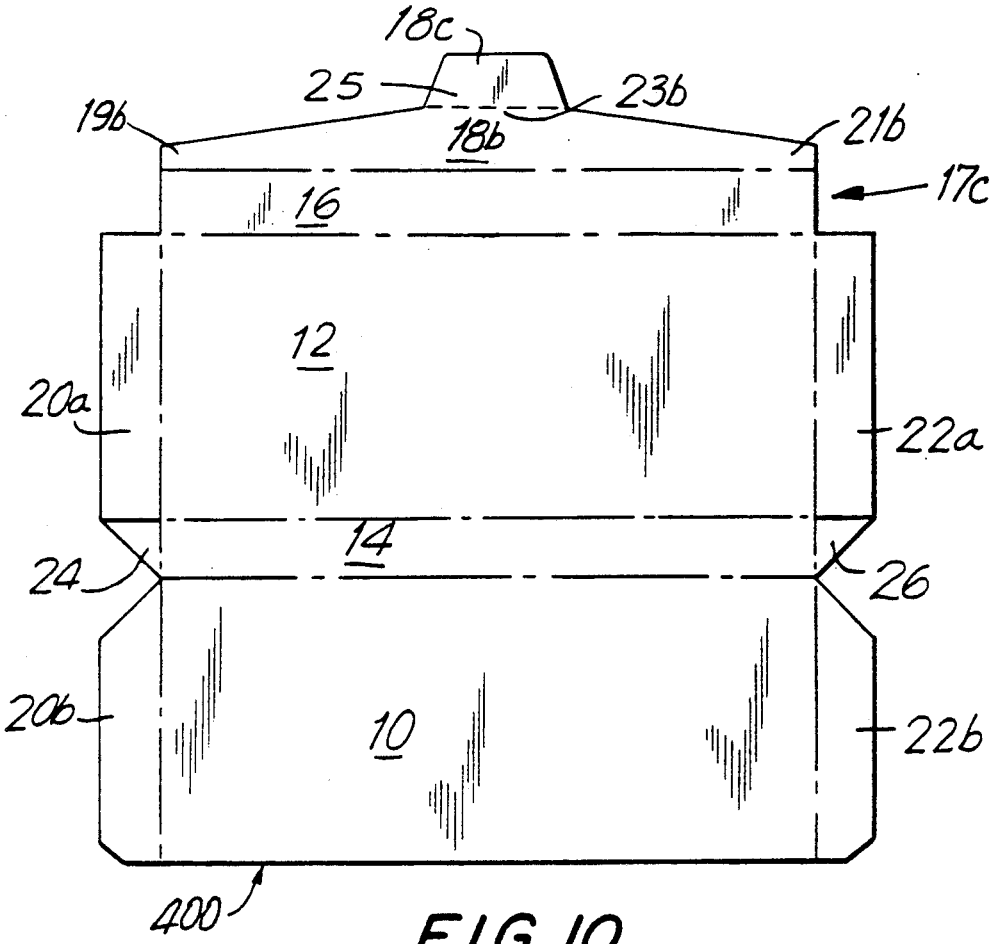
FIG. 10 is a plan view of an illustrative carton blank similar to that of FIG. 9, but having an additional tuck-in portion.
Figure 14:
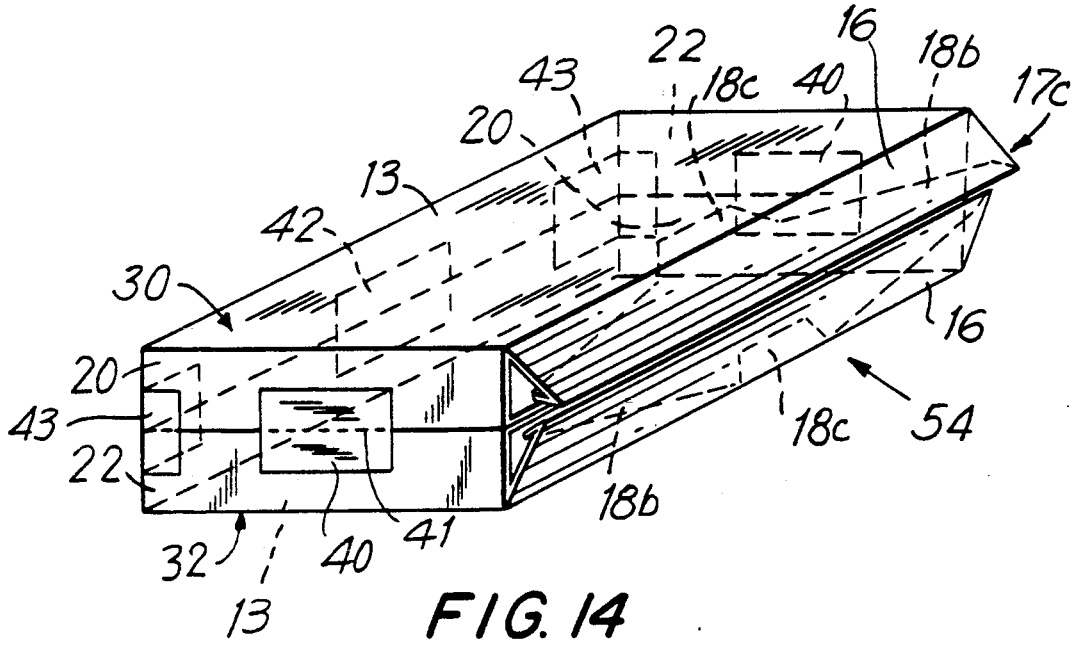
FIG. 14 is an isometric view of two five-pack cartons formed from the blank of FIG. 10, joined to form a dual carton, and having the tuck-in portions of the tuck-in flaps folded under the top closure portion and the additional tuck-in portion tucked between the exterior walls of the cartons and the cigarette packs in the cartons.
Figure 11:
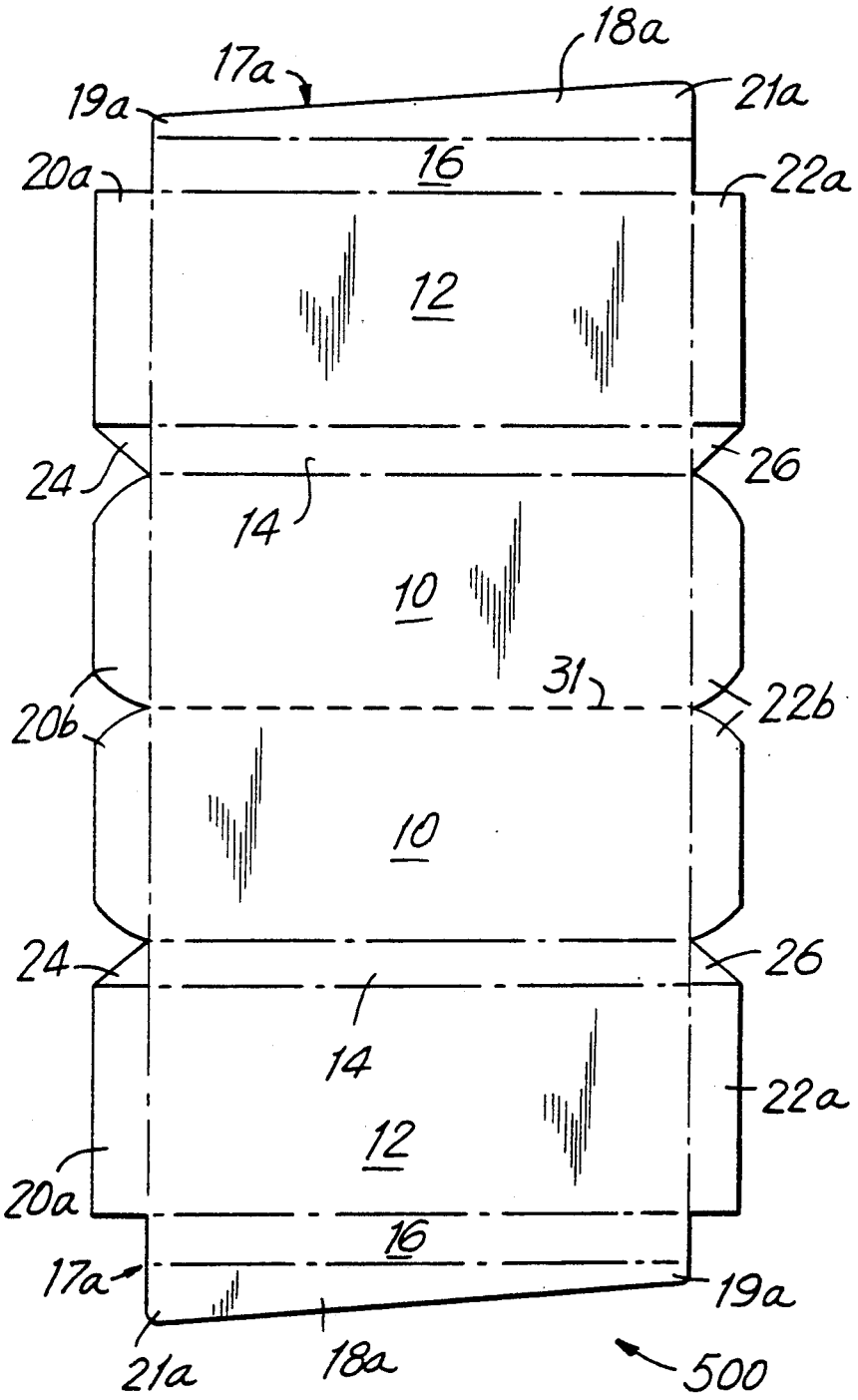
FIG. 11 is a plan view of an illustrative carton blank for forming two five-pack cartons joined by a perforated line, each half similar to the blank of FIG. 8.

The tuck-in flap 17*c* of blank 400 shown in FIG. 10 is substantially the same as that of blank 300, except for an additional tuck-in extension 18*c* extending from central portion 23*b* of tuck-in panel 18*b*. Tuck-in extension 18*c* may be joined to tuck-in panel 18*b* along perforated line 25 to facilitate later removal. As shown in FIG. 14, when two blanks 400 are folded into cartons 30 and 32 and joined to form dual carton 54, tuck-in extension 18*c* may be tucked between exterior wall 13, and the cigarette packs which are contained in the completed carton. Such tucking is accomplished by folding tuck-in flaps 17*c* of cartons 30 and 32 such that tuck-in panel 18*b* is positioned beneath top closure panel 16, so that extension 18*c* is adjacent the top of exterior wall 13. Each tuck-in flap 17*c* thus resembles the short lap flap of a standard cigarette carton, so that neither tuck-in flap 17*c* has a long portion which may be snagged by the hold-down guide for the shorter lap flap. Cartons 30 and 32 are preferably joined by labels 40, 42, and 43, such as those shown in FIG. 12. Tuck-in flaps 17*c* are temporarily joined to close dual carton 54 by applying a label similar to the above-mentioned labels (not shown) across the tops of the flaps.

Figure 16:
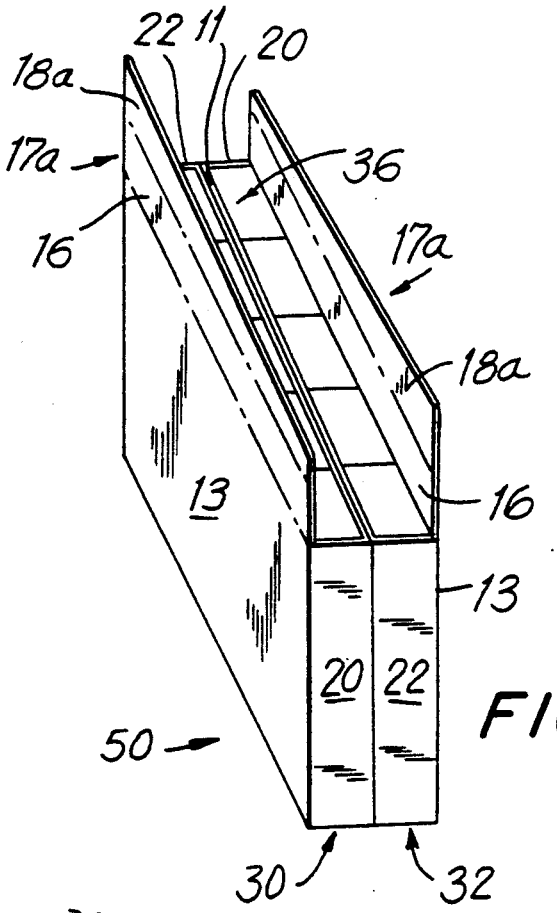
FIG. 16 is an isometric view of the dual carton of FIG. 12, with its flaps open so that a tax stamp may be applied to the exposed ends of the cigarette packs in the carton.
Figure 17:
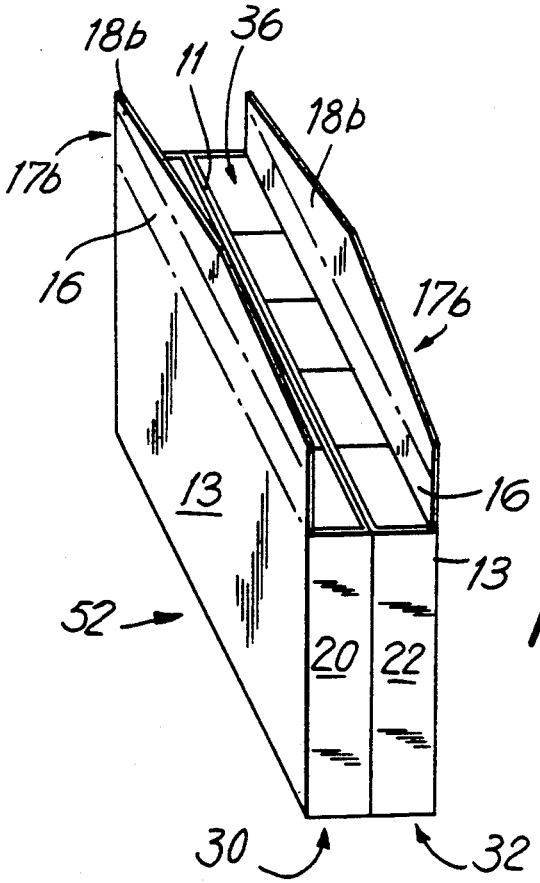
FIG. 17 is an isometric view of the dual carton of FIG. 13, with its flaps open so that a tax stamp may be applied to the exposed ends of the cigarette packs in the carton.
Figure 18:
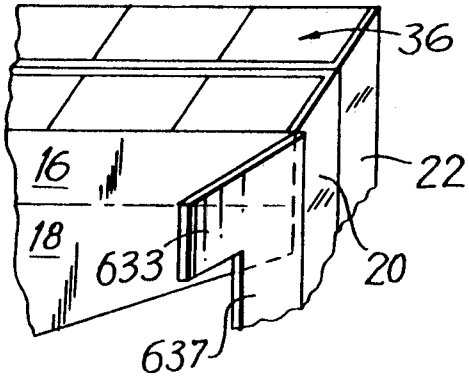
FIG. 18 is a partial side view of a carton having a tapered tuck-in flap being held down by a hold-down guide for a short lap flap.
Figure 19:
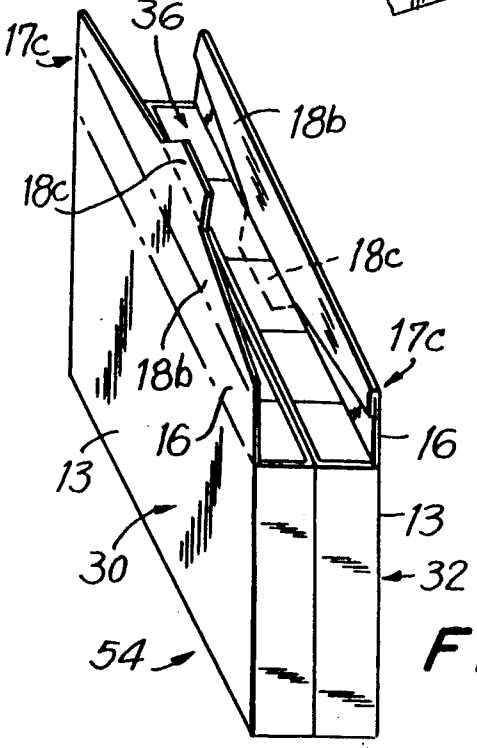
FIG. 19 is an isometric view of the dual carton FIG. 14, but in which only the tuck-in portion of one tuck-in flap is folded under its adjoining top closure portion, and in which both flaps are open so that a tax stamp may be applied to the exposed ends of the cigarette packs in the carton.

As shown in FIGS. 16, 17, and 19, the tuck-in flaps of dual cartons 50, 52, and 54 resemble conventional lap flaps of a cigarette carton at the end of the carton which leads into the tax-stamping machine, after the plow of the tax-stamping machine has opened the lapped or otherwise temporarily sealed tuck-in flaps. Thus, once the flaps are folded substantially parallel to exterior walls 13, the tapered portion encountering hold-down guide 632 is held down so that the longer portion of tuck-in portion 18 will be sufficiently held flat against exterior wall 13. As shown in FIG. 18, horizontal portion 633 holds down the short section of tapered tuck-in portion 18, as if the short section were a short lap flap, so that once the longer portion passes through hold-down guide 632, the tuck-in portion will be flat against exterior wall 13 and will not be snagged against vertical portion 637.

Dual carton 50 of FIG. 16, formed from blanks such as blank 200 or blank 500, is shown after previously overlapped tuck-in flaps 17*a* have been plowed open to apply a tax stamp to the ends of cigarette packs 36 in the carton. Carton 50 may be used in a tax-stamping machine in which the hold-down guide for the shorter lap flap of a conventional carton is on the right side of the machine. In such a machine, the short flap of the conventional carton must lead into the machine on the right side. Dual carton 50 enters a tax-stamping machine with an initially short flap on the right side of the carton. The flap is short for a sufficient width of tuck-in panel 18*a* so that once tuck-in panel 18*a* becomes wider, tuck-in flap 17*a* will have been held down long enough for the longer portion to remain folded down adjacent exterior wall 13 and consequently be snagged by a hold-down guide. Blanks 200 and 500 would have to be altered if the cartons formed from these blanks are to be passed through a machine in which the hold-down guide for the shorter lap flap is on the left side. Accordingly, end 19*a* of tuck-in panel 18*a* would have to be the longer end and end 21*a* of tuck-in panel 18*a* would have to be the shorter end. If desired, cartons 30 and 32 of carton 50 may be formed from blanks which would allow for short end 19*a* of both tuck-in panels 18*a* to be positioned at the same end of carton 50, and long end 21*a* of both tuck-in panels 18*a* to be positioned at the other end of carton 50.

Dual carton 52 formed from blanks such as blank 300, is shown in FIG. 17 after previously overlapped flaps 17*b* have been plowed open to apply a tax stamp to the ends of cigarette packs 36. Carton 52 may be used in a tax-stamping machine with the hold-down guide for the shorter lap flap either on the right or the left side. Either end of the dual carton 52 initially presents a short flap on both sides of the carton. Both flaps are short for a sufficient width of tuck-in panel 18*b* so that once tuck-in panel 18*b* becomes wider, tuck-in flap 17*b* will have been held down long enough for the longer portion to remain folded down adjacent exterior wall 13 and not move away from exterior wall 13 and consequently be snagged by a hold-down guide.

Although carton 52 may be preferable to carton 50 because it is not orientation specific, carton 52 allows less time for flaps 17*b* to be held down to clear the hold-down guide without snagging the longer portion of flap. Tuck-in flaps 17*a* widen more gradually than tuck-in flaps 17*b* and the wider flap trails into the machine at the end, once the flaps are almost certainly held down well enough so that snagging will not occur. However, carton 52 may still be preferable, aesthetically, because of its symmetry.

Flaps 17*c* of carton 54 may be folded to most closely resemble a conventional cigarette carton having lap flaps. As shown in FIG. 19, one flap, here tuck-in flap 17*c* of carton 32, may folded such that tuck-in extension 18*c* is positioned between exterior wall 13 and cigarette packs 36. The folded flap thus has substantially the same dimension as the shorter lap flap of a conventional carton having lap flaps. This flap may later be unfolded and tucked into carton 32. Tuck-in flap 17*c* of carton 30 may additionally or alternatively be folded such that tuck-in extension 18*c* is positioned between exterior wall 13 and cigarette packs 36.

Figure 20:
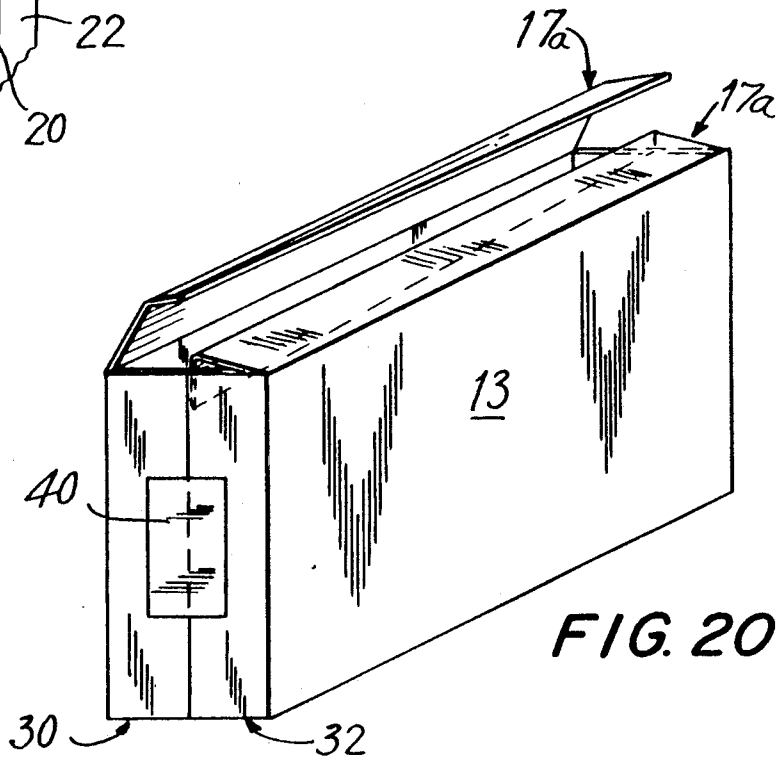
FIG. 20 is an isometric view of the dual carton of FIG. 12 after tax-stamping, and showing the tucking of the tuck-in flaps into the carton.

After a tax stamp has been applied to the ends of each of cigarette packs 36, tuck-in flaps 17*a*, 17*b*, and 17*c* may be folded into their respective cartons to seal the cartons for distribution to consumers, as shown in FIG. 20. Preferably, a mechanized means for tucking the flaps into the cartons is used, and the longest part of the flap is tucked first, the shorter part following. A label similar to label 40 may be placed over the top closure panels 16 of adjacent cartons 30 and 32 to further join the cartons, or the cartons may be separated by severing any labels which were applied to adjacent coplanar walls of the dual cartons to join the cartons for tax-stamping.

Although cartons 30 and 32 are described as each dimensioned to hold one row of five cigarette packs, they may be lengthened or shortened to hold more or fewer than five packs, and may, also or alternatively be widened to contain more than one row of cigarette packs.

Although dual cartons 50, 52, and 54 are shown formed by two substantially identical blanks, dual cartons may be formed by cartons 30 and 32 formed from different blanks. For example, a dual carton may be formed from a first carton 30 formed from blank 200 and a second carton 32 formed from blank 300.

Although cartons 30 and 32 are shown joined by labels positioned across adjacent coplanar exterior walls, cartons 30 and 32 may also be joined by carrier means bearing adhesive on both sides, positioned between the cartons. Furthermore, any number of labels, in any combination may be used to join the cartons. Additionally, a transparent band of material, such as common in the art, may be wrapped around the cartons to further secure them together Although tuck-in flaps 17 are shown overlapped, tuck-in panel 18 may be folded under top closure panel 16 in any embodiment, not only that of blank 400, so that either or both tuck-in flaps 17 resemble the shorter lap flap of a conventional carton.

Although extension panels 18*a*, 18*b*, and 18*c* are described as being tucked into the carton, these panels may alternatively be joined to the outer surface of wall 10 of the carton from which the panel extends to close the carton.

It will be appreciated that references to cigarette cartons and cigarette packs are not limited to only rectangular cartons and packs, but are intended to include all configurations which are available to consumers. Cigarette cartons include cartons with windows, cartons with rounded edges, and other configurations which are designed to be passed through tax-stamping equipment. Cigarette packs include such packs as oval packs, packs with rounded edges, and other non-rectangular shapes.

It will be appreciated that references to tax-stamping machinery are intended to include any existing equipment which is readily available to distributors, and modified versions.

It will be appreciated that the directional references "top", "bottom", "front", and "rear" do not limit the respective panels to such orientation, but merely serve to distinguish these panels from one another.

It will be understood that the foregoing is merely illustrative of the principles of the invention, and that various modification can be made by those skilled in the art without departing from the scope and spirit of the invention. The present embodiments are described for the purpose of illustration rather than limitation, and the present invention is limited only by the claims which follow.

What is claimed is:

1. A cigarette carton for packaging a first number of cigarette packs and of dimensions compatible with commercially available tax-stamping machinery used in the automated processing of cigarette cartons and having hold-down guides for holding down the short and long lap flaps of a typical cigarette carton adjacent the exterior sides of the carton, each said cigarette pack having a pair of opposed long walls and a pair of opposed short walls, said cigarette carton having a first end and a second end and comprising:

a first pair of first and second opposed exterior walls, each said first and second wall having a first edge adjacent said first end of said carton and a second edge adjacent said second end of said carton;

a second pair of third and fourth opposed side walls adjoining and substantially perpendicular to said first pair of opposed exterior walls;

a first extension panel extending from said first edge of said first wall and having a distal edge which lies substantially half way between said first and second walls when said first extension panel is folded substantially perpendicular to said first wall and toward said second wall;

a second extension panel extending from said first edge of said second wall and having a distal edge which lies substantially half way between said first and second walls when said second extension panel is folded substantially perpendicular to said second wall and toward said first wall;

a third extension panel extending from said distal edge of said first extension panel and having a free edge and a fourth extension panel extending from said distal edge of said second extension panel and having a free edge; wherein:

at least one of said third and fourth extension panels has at least one tapered portion along the width of said free edge;

the length of the shortest portion of said at least one tapered portion is sufficiently long to be tucked inside said carton and remain tucked inside said carton and sufficiently short along a sufficient width of said third and fourth extension panels so that said at least one one of said third and fourth extension panels is not snagged by a hold-down guide for a short lap flap;

the shortest portion of said at least one tapered portion is adjacent one of said third and fourth side walls such that when said one of said third and fourth side walls is the first of said second pair of walls to approach said hold-down guide for a short lap flap and said at least one tapered portion is on the side of said tax-stamping machine at which said hold-down guide is positioned, the free edge of said at least one of said third and fourth extension panels is close enough to said hold-down guide for a short lap flap to be held down by said hold-down guide without being snagged, and said at least one of said third and fourth extension panels is sufficiently held down once the longest portion of said at least one of said third and fourth extension panels reaches said hold-down guide such that the longest portion of said at least one of said third and fourth extension panels is not snagged by said hold-down guide.

2. The cigarette carton of claim 1 wherein:

said carton comprises first and second cigarette cartons joined together to form a dual carton dimensioned to contain said first number of cigarette packs;

said first exterior wall comprises a wall of said first cigarette carton;

said second exterior wall comprises a wall of said second cigarette carton;

each of said third and fourth side walls comprises a first side wall from one of said two cigarette cartons and a second adjacent coplanar side wall from the other of said two cigarette cartons.

3. The cigarette carton of claim 2 wherein said two cigarette cartons are formed from separate blanks.

4. The cigarette carton of claim 2 wherein:

said first cigarette carton has a fifth interior wall opposite said first exterior wall;

said second cigarette carton has a sixth interior wall adjacent and coextensive with said fifth wall and between said fifth interior wall and said second exterior wall; and said first and second exterior walls remain readily visible while said fifth and sixth interior walls are not readily visible when said first and second cartons are joined to form a dual carton.

5. The cigarette carton of claim 4 wherein said first and second cartons are formed from the same blank and joined along a perforated line along said fifth and sixth interior walls at said first end of said carton.

6. The cigarette carton of claim 4 wherein said third extension panel is tucked into said carton between said fifth interior wall and said cigarette packs contained in said carton, and said fourth extension panel is tucked into said carton between said sixth interior wall and said cigarette packs contained in said carton.

7. The cigarette carton of claim 4 further including:

a first bottom wall adjacent said second end of said carton and extending between said first and fifth walls; and a second bottom wall adjacent said second end of said carton and extending between said second and sixth walls; wherein:

said first and second bottom walls are adjacent and substantially coplanar.

8. The cigarette carton of claim 7 further including carrier means bearing adhesive positioned across adjacent coplanar walls of said two cigarette cartons to join said cartons with said adhesive in operative contact with said last-mentioned walls.

9. The cigarette carton of claim 2 wherein when said first, second, third, and fourth extension panels are overlapped to close said carton, said free edge of the longest portion of said at least one tapered portion lies adjacent said first edge of the wall opposite the wall from which said at least one of said third and fourth extension panels extends.

10. The cigarette carton of claim 9 wherein said first, second, third, and fourth extension panels are overlapped and releasably secured in said overlapped position to be transported to a distributor and plowed open by a tax-stamping machine.

11. The cigarette carton of claim 9 wherein said at least one of said third and fourth extension panels having at least one tapered portion includes both said third and fourth extension panels.

12. The cigarette carton of claim 2 further including carrier means bearing adhesive positioned across adjacent coplanar walls of said first and second cigarette cartons with said adhesive in operative contact with said last-mentioned walls to join said cartons.

13. The cigarette carton of claim 2 wherein said at least one tapered portion of at least one of said third and fourth extension panels comprises a single tapered portion having a short end adjacent one of said third and fourth walls and a long end adjacent the other of said third and fourth walls.

14. The cigarette carton of claim 13 wherein said at least one of said third and fourth extension panels having at a single tapered portion includes both said third and fourth extension panels.

15. The cigarette carton of claim 2 wherein said at least one tapered portion of at least one of said third and fourth extension panels comprises two tapered portions forming a substantially pointed long section proximal the center of said at least one extension panel.

16. The cigarette carton of claim 15 wherein said at least one of said third and fourth exterior panels having two tapered portions includes both said third and fourth extension panels.

17. The cigarette carton of claim 15 further including an additional extension portion extending from said substantially pointed long section of said at least one of said third and fourth extension panels, wherein said additional extension portion may be tucked between said wall of said carton from which said at least one extension panel extends and between cigarette packs contained in said carton when said at least one of said third and fourth extension panel is folded under the extension panel from which said at least one extension panel extends.

18. The cigarette carton of claim i wherein the width of each said first and second exterior wall is at least as wide as a second number of times the width of the long wall of a cigarette pack to be contained in said carton and the width of each said third and fourth side wall is at least as wide as a third number of times the width of the short wall of a cigarette pack to be contained in said carton such that said first number of cigarette packs equal to the product of said second number of times the width of the long wall of a cigarette pack and the third number of times the width of the short wall of a cigarette pack can be positioned inside said carton.

19. The cigarette carton of claim 1 wherein the shortest portion of said at least one tapered extension panel is approximately one-quarter the length of said first or second extension panels.

20. The cigarette carton of claim 1 wherein the length of the longest portion of at least one of said third and fourth extension panels is substantially the same length as said first or second extension panel.

21. The cigarette carton of claim 1 wherein said at least one of said third and fourth extension panels having a tapered portion includes both said third and fourth extension panels.

22. The cigarette carton of claim 1 wherein when said first, second, third, and fourth extension panels are overlapped to close said carton, said free edge of the longest portion of said at least one tapered portion lies adjacent said first edge of the wall opposite the wall from which said at least one of said third and fourth extension panels extend.

23. The cigarette carton of claim 22 wherein said first, second, third, and fourth extension panels are overlapped and releasably secured to close said first end of said carton so that said carton may be transported to a distributor and plowed open by a tax-stamping machine.

24. The cigarette carton of claim 22 wherein said at least one of said third and fourth extension panels having a tapered portion includes both said third and fourth extension panels.

25. The cigarette carton of claim 1 wherein said at least one tapered portion of at least one of said third and fourth extension panels comprises a single tapered portion having a short end adjacent one of said third and fourth walls and a long end adjacent the other of said third and fourth walls.

26. The cigarette carton of claim 25 wherein the shortest portion of said tapered extension panel is approximately one-quarter the length of said first or second extension panels.

27. The cigarette carton of claim 25 wherein said at least one of said third and fourth extension panels having a single tapered portion includes both said third and fourth extension panels.

28. The cigarette carton of claim 27 wherein the short end of said third extension panel is adjacent one of said third and fourth walls and the short end of said fourth extension panel is adjacent the other of said third and fourth walls.

29. The cigarette carton of claim 27 wherein the short end of said third extension panel and the short end of said fourth extension panel are adjacent the same one of said third and fourth walls.

30. The cigarette carton of claim 1 wherein said at least one tapered portion of at least one of said third and fourth extension panels comprises two tapered portions forming a substantially pointed long section proximal the center of said at least one extension panel.

31. The cigarette carton of claim 30 wherein said at least one of said third and fourth extension panels having two tapered portions includes both said third and fourth extension panels.

32. The cigarette carton of claim 30 further including an additional extension portion extending from said substantially pointed long section of said at least one of said third and fourth extension panels having two tapered portions, wherein said additional extension portion may be tucked between said wall of said carton from which said at least one extension panel extends and between cigarette packs contained in said carton when said at least one of said third and fourth extension panels is folded under said extension panel from which said at least one extension panel extends.

33. The cigarette carton of claim 32 wherein said at least one of said third and fourth extension panels having two tapered portions includes both said third and fourth extension panels.

34. The cigarette carton of claim 33 wherein said at least one of said third and fourth extension panels having an additional extension panel includes both said third and fourth extension panels.

35. The cigarette carton of claim 32 wherein:

said at least one of said third and fourth extension panels is folded beneath said extension panel from which it extends; and said additional extension panel extending from said folded extension panel is tucked between said wall from which said at least one extension panel extends and cigarette packs contained within said carton.

36. The cigarette carton of claim 35 wherein the other of said third and fourth extension panels is positioned substantially coplanar to said extension panel from which it extends and above said at least one of said third and fourth extension panels, such that said first, second, third, and fourth extension panels resemble lap flaps.

37. The cigarette carton of claim 36 wherein said lapped extension panels are secured to one another to temporarily close said carton.

38. The cigarette carton of claim 35 wherein said at least one of said third and fourth extension panels having two tapered portions and an additional extension portion, and folded beneath the extension panel from which it extends includes both said third and fourth extension panels.

39. The cigarette carton of claim 38 further including a carrier means bearing adhesive positioned across said first and second extension panels to temporarily close said carton.

40. The cigarette carton of claim 39 wherein said carrier means includes a line of weakness positioned substantially parallel to said distal edges of said first and second extension panels.

41. The cigarette carton of claim 40 wherein said line of weakness comprises a perforated line.

42. The cigarette carton of claim 32 wherein said additional extension panel is joined to said one of said third and fourth extension panels along a line of weakness.

43. The cigarette carton of claim 42 wherein said line of weakness comprises a perforated line.

44. A method for passing a cigarette carton through a tax-stamping machine having a hold-down guide for a short lap flap, wherein said cigarette carton has a first end and a second end and comprises a first pair of opposed first and second exterior walls each having a first edge adjacent said first end and a second edge adjacent said second end; a second pair of opposed third and fourth side walls adjoining and substantially perpendicular to said first pair of opposed walls; a first extension panel extending from said first edge of said first wall and having a distal edge which lies substantially half way between said first and second walls when said first extension panel is folded substantially perpendicular to said first wall and toward said second wall; a second extension panel extending from said first edge of said second wall and having a distal edge which lies substantially half way between said first and second walls when said second extension panel is folded substantially perpendicular to said second wall and toward said first wall; a third extension panel extending from said distal edge of said first extension panel; and a fourth extension panel extending from said distal edge of said second extension panel; said method comprising the steps of:

providing at least one of said third and fourth extension panels with at least one tapered portion adjacent one of said third and fourth side walls;

positioning said carton with said first and second exterior walls substantially parallel to the path of travel through said tax-stamping machine and with said one of said third and fourth walls leading first into said tax-stamping machine so that the shortest portion of said tapered portion is first to approach and be held down by said hold-down guide for a short lap flap; wherein:

said shortest portion of said tapered portion is sufficiently short and extends along a sufficient width of said panel such that said at least one extension panel is not snagged by said hold-down guide when said carton is passed through said tax-stamping machine.

45. The method of claim 44 further including the step of leaving said hold-down guide for a short lap flap in a position required for conventional cigarette cartons having a long and short lap flap, which carton is typically passed through said tax-stamping machine.

46. The method of claim 44 further including the steps of:

overlapping the flaps formed by said first, second, third, and fourth extension panels;

temporarily securing said flaps to close said first end of said carton;

passing said carton through said tax-stamping machine;

opening said first end of said carton by inserting a plow beneath said flaps to separate said flaps;

folding said flaps so that said flaps are adjacent the exterior of said carton and substantially parallel to said first and second walls; and passing said carton through a pair of hold-down guides positioned to hold down the short and long lap flaps of a conventional cigarette carton typically passed through said tax-stamping machine;

wherein said at least one tapered portion is sufficiently held down by said hold-down guides such that the longer portion of said at least one tapered portion is not snagged by said hold-down guide.

47. The method of claim 46 further including the steps of:

applying a tax stamp to the end of each cigarette pack contained in said carton;

tucking said flaps into said cartons by folding said first and second extension panels substantially perpendicular to said first and second walls, and said third and fourth extension panels into said cartons and substantially perpendicular to said first and second extension panels.

48. The method of claim 47 wherein:

said tucking step is accomplished by tucking the longest portion of said at least one tapered portion into said carton first so that the shorter portion follows in; and the shortest portion of said at least one tapered portion is sufficiently long to remain tucked inside said carton.

49. The method of claim 44 wherein said carton comprises two cartons and said method further includes the step of joining said two cartons to form a dual carton of dimensions compatible with commercially available tax-stamping machinery.

50. The method of claim 44 wherein said step of providing at least one of said third and fourth extension panels with at least one tapered portion includes the step of providing both said third and fourth extension panels with at least one tapered portion, the shortest portion of each said tapered portion adjacent one of said third and fourth walls.

51. The method of claim 50 wherein said step of providing at least one tapered portion includes the step of providing two tapered portions to at least one of said third and fourth extension panels such that said two tapered portions form a substantially pointed section proximal the center of said at least one of said third and fourth extension panels.

52. The method of claim 51 wherein said step of providing two tapered portions includes the step of providing two tapered portions to both said third and fourth extension panels.

53. The method of claim 51 further including the step of providing an additional extension panel extending from said substantially pointed section which may be tucked between said wall from which said extension panel extends and said cigarette packs contained in said carton when said at least one of said third and fourth extension panels is folded beneath the extension panel from which said at least one of said third and fourth extension panels extends.

54. A method for passing a cigarette carton through a tax-stamping machine having a hold-down guide for a short lap flap, wherein said cigarette carton has a first end and a second end and comprises a first pair of opposed first and second exterior walls each having a first edge adjacent said first end and a second edge adjacent said second end; a second pair of opposed third and fourth side walls adjoining and substantially perpendicular to said first pair of opposed walls; a first extension panel extending from said first edge of said first wall and having a distal edge which lies substantially half way between said first and second walls when said first extension panel is folded substantially perpendicular to said first wall and toward said second wall; a second extension panel extending from said first edge of said second wall and having a distal edge which lies substantially half way between said first and second walls when said second extension panel is folded substantially perpendicular to said second wall and toward said first wall; a third extension panel extending from said distal edge of said first extension panel; and a fourth extension panel extending from said distal edge of said second extension panel; said method comprising the steps of:

providing at least one of said third and fourth extension panels with an additional extension panel proximal the center of said panel;

folding said at least one of said third and fourth extension panels below the extension panel from which said at least one of said third and fourth extension panels extends; and tucking said additional extension panel between the wall from which said at least one of said third and fourth extension panels extends and between cigarette packs contained in said carton;

whereby said folding step causes said at least one of said third and fourth extension panels and the extension panel from which said at least one of said third and fourth extension panels extends to have substantially the same dimension as the short lap flap of a conventional cigarette carton which is typically passed through said tax-stamping machine, so that said hold-down guide for a short lap flap does not need to be adjusted for said carton.

55. The method of claim 54 further including the steps of:

providing both said third and fourth extension panels with an additional extension panel;

folding both said third and fourth extension panels below said first and second extension panels, respectively;

tucking said additional extension panel of said third extension panel between cigarette packs contained within said carton and between said first wall; and tucking said additional extension panel of said fourth extension panel between cigarette packs contained within said carton and between said second wall;

whereby said first and third extension panels and said second and fourth extension panels have substantially the same dimensions as the short lap flap of a conventional cigarette carton so that none of said extension panels will be snagged by said hold-down guide.

56. The method of claim 55 further including the step of providing a carrier means bearing adhesive across said first and second extension panels with said adhesive in operative contact with said last-mentioned extension panels to thereby close said carton.

57. The method of claim 54 further including the steps of:

positioning said carton with said first and second exterior walls substantially parallel to the path of travel through said tax-stamping machine and with said folded extension panels on the side of said hold-down guide for a short lap flap such that said folded extension panels are held down by said hold-down guide.

58. The method of claim 57 further including the steps of:

folding said folded extension panels substantially perpendicular to said first and second walls;

folding the other of said third and fourth extension panels over the extension panel from which said at least one of said third and fourth extension panels having an additional extension panel extends;

temporarily securing the overlapped extension panels together to thereby close said first end of said carton;

opening said first end of said carton by inserting a plow beneath said extension panels to separate said extension panels;

folding said extension panels so that said extension panels are adjacent the exterior of said carton and substantially parallel to said first and second walls; and passing said carton through a pair of hold-down guides positioned to hold down the short and long lap flaps of a conventional cigarette carton typically passed through said tax-stamping machine;

wherein said extension panel having said additional extension panel is sufficiently held down by said hold-down guide for a short flap such that said extension panels of said carton are not snagged by said hold-down guides.

59. The method of claim 58 further including the steps of:

applying a tax stamp to the end of each cigarette pack contained in said carton;

unfolding said folded extension panels;

folding said first and second extension panels substantially perpendicular to said first and second walls; and folding said third and fourth extension panels into said cartons and substantially perpendicular to said first and second extension panels.

* * * * *